US005335386A

United States Patent [19]

Newell

[11] Patent Number: 5,335,386

[45] Date of Patent: Aug. 9, 1994

[54] BRIDGE STRUCTURE

[76] Inventor: Donald J. Newell, 129 Lick Meadow Rd., Bristol, Tenn. 37620

[21] Appl. No.: 44,019

[22] Filed: Apr. 8, 1993

[51] Int. Cl.[5] ..... E01D 1/00

[52] U.S. Cl. ..... 14/74.5; 14/14; 52/263

[58] Field of Search ..... 14/2.4, 13, 3, 77.1, 14/74.5, 73.1; 404/35; 52/168, 93.2, 90.1, 745.05, DIG. 12, 262

[56] References Cited

U.S. PATENT DOCUMENTS

| | | | |
|---|---|---|---|
| 120,319 | 10/1871 | Perry et al. | 14/14 |
| 121,374 | 11/1871 | Jackson | 14/14 |
| 145,685 | 12/1873 | Reiling | 14/14 |
| 265,331 | 10/1882 | Litell | 14/4 |
| 328,758 | 10/1885 | Carr | 14/14 |
| 1,162,038 | 11/1915 | Cool | 14/14 |
| 4,042,991 | 8/1977 | Macy et al. | 14/74.5 |
| 4,593,509 | 6/1986 | Linton | 52/90.1 |

*Primary Examiner*—Thuy M. Bui
*Assistant Examiner*—Pamela O'Connor

[57] ABSTRACT

A bridge structure is provided for short bridges spans of eighty feet or less in length and includes a series of girders consisting of flanged steel beams. The girders are maintained in place by lateral braces which hold the girders with a series of tie rods or bolts affixed thereto. In one embodiment the lateral braces are formed with top and bottom steel members of relatively small size and which are notched to help maintain the girders in position. Side rail posts are affixed at the ends of the lateral braces for attachment of a guardrail or the like. The longitudinally positioned girders are not welded or weakened with bolt holes therethrough and the structure provides a convenient and economical bridge constructions for use with conventional timber or other decking.

14 Claims, 4 Drawing Sheets

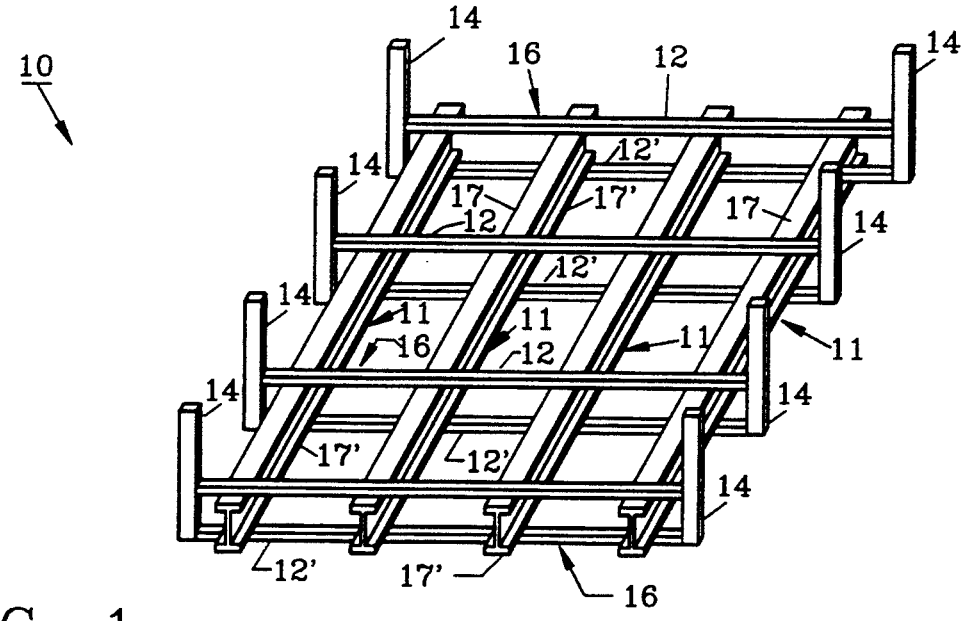
FIG. 1
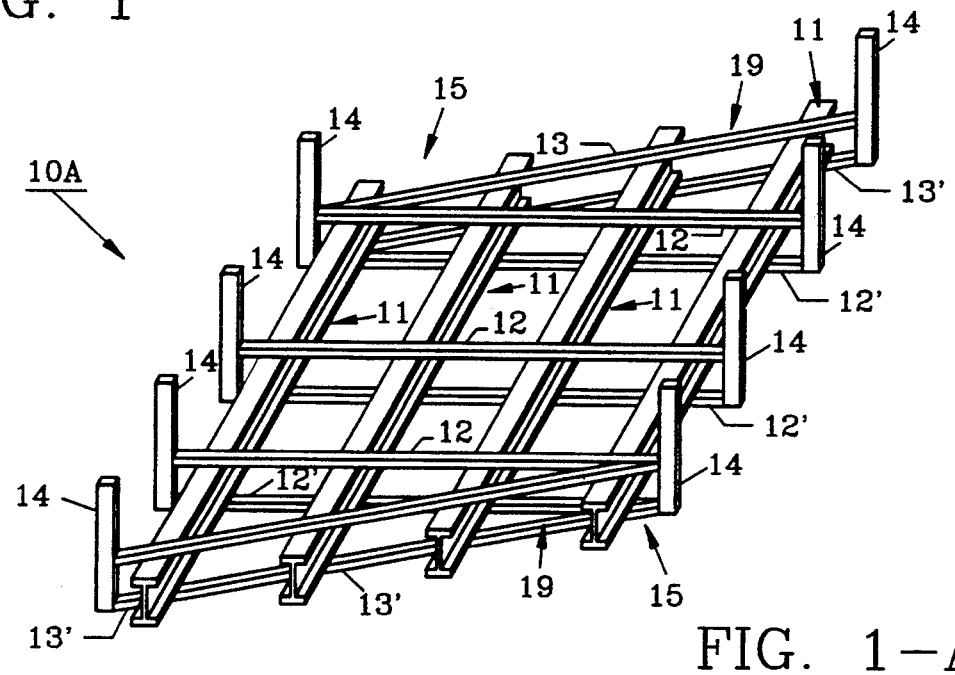
FIG. 1-A
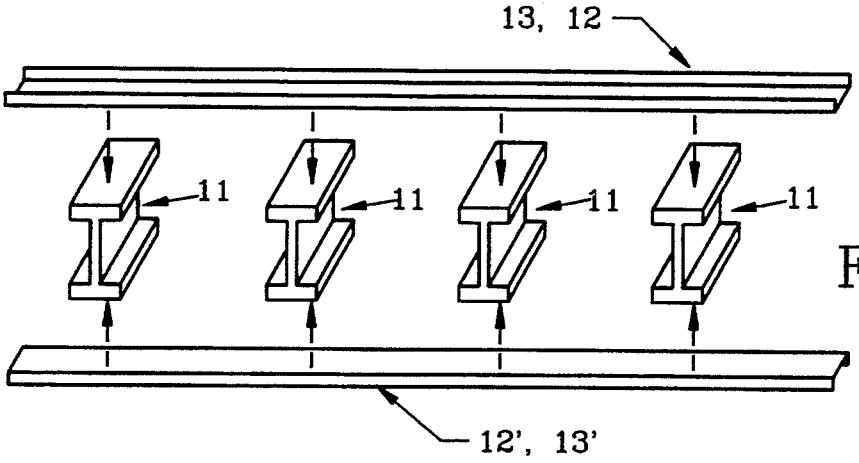
FIG. 1-B

BRIDGE STRUCTURE

BACKGROUND OF THE INVENTION

1. Field Of The Invention

The invention herein pertains to certain bridge supporting structures, and particularly to "short span" highway bridge structures for spans which are generally eighty feet or less.

2. Description Of The Prior Art And Objectives Of The Invention

It has been estimated that as many as two hundred thousand of this nation's highway bridges are deficient and must be replaced or substantially repaired in the near future. Many of the bridges which are deficient are of the "short span" type, i.e., are less than eighty feet in length generally used by motor vehicles on secondary roads and highways. The supporting structure of these short span secondary highway bridges may be either longitudinal concrete or steel girders, positioned parallel to the centerline of the roadway which provide the primary strength and load support across the span. Steel girders usually require supplemental lateral restraints for lateral rigidity which under conventional bridge constructions involves steel cross bracing between the girders. However, conventional bridge constructions which utilize steel girders have bolt holes therein or welded clips thereto required for connecting the lateral bracing to the girders and for the attachment of the supports for the guard rails on each side of the bridge. Such bridges generally have concrete decking, however bridges with steel girders often use treated timber decking which is an established, economical and proven bridge deck comparing favorably on ability to withstand freezing weather and salting operations. Such bridges have proved uneconomical to manufacture and install and are often insufficient in long term guardrail rigidity. Conventional bridge construction is also expensive and labor intensive, and in some instances has prohibited local governments from repairing or replacing bridges until they are dangerously decrepit.

It is therefore an objective of the present invention to provide a bridge structure and design which has components that can be easily fabricated by relatively unskilled workers and which can be delivered to the job site for assembly and installation with ease and convenience.

It is another objective of the present invention to provide a bridge structure in which the principal components for lateral bracing are standardized and can be utilized in any width, skew or span of bridge and which may be mass produced and warehoused for economy purposes.

It is also another objective of the present invention to provide a bridge structure easily adaptable to any skew or angle of the span crossing with minimum engineering or fabrication required.

It is still another objective of the present invention to provide the lateral bracing for a girder bridge structure whereby each lateral brace consists of a pair of steel members, one above and the other below the girders, and each steel member is continuous across the width of the bridge.

It is another objective of the present invention to provide a bridge structure which utilizes a relatively small number of components yet which will provide the stability and rigidity for all state and federal requirements.

It is yet another objective of the present invention to provide a bridge structure whereby the lateral braces are securely affixed at each girder without penetrating the girder or welding thereto.

Various other objectives and advantages of the present invention will become apparent to those skilled in the art as a more detailed presentation is set forth below.

SUMMARY OF THE INVENTION

A bridge structure is presented have a plurality of longitudinal girders which are laterally affixed in place by continuous lateral braces joined thereto. Each lateral brace consists of a pair of steel members, one attached to the top and the second attached to the underside of the girders and vertically aligned. The lateral bracing members are affixed at the girders by various means including bolting or tie rods in combination with locking and/or spacing plates or member notching. The ends of the lateral braces are connected to and anchor the vertical guardrail support posts. Conventional bridge construction concrete, treated timber, or other decking is placed over the top of the resultant supporting bridge structure for the road bed.

BRIEF DESCRIPTION OF THE DRAWINGS

FIG. 1 shows a perspective schematic view of a short span bridge structure of the invention with arrangement of lateral bracing for spans with a skew angle less than twelve degrees;

FIG. 1A shows a perspective schematic view of a short span bridge structure of the invention with arrangement of lateral bracing for spans with skew angles greater than twelve degrees;

FIG. 1B demonstrates the positioning of the two members of a lateral brace in an exploded schematic view of a segment of the bridge;

DESCRIPTION OF THE PREFERRED EMBODIMENT

Figure 2:
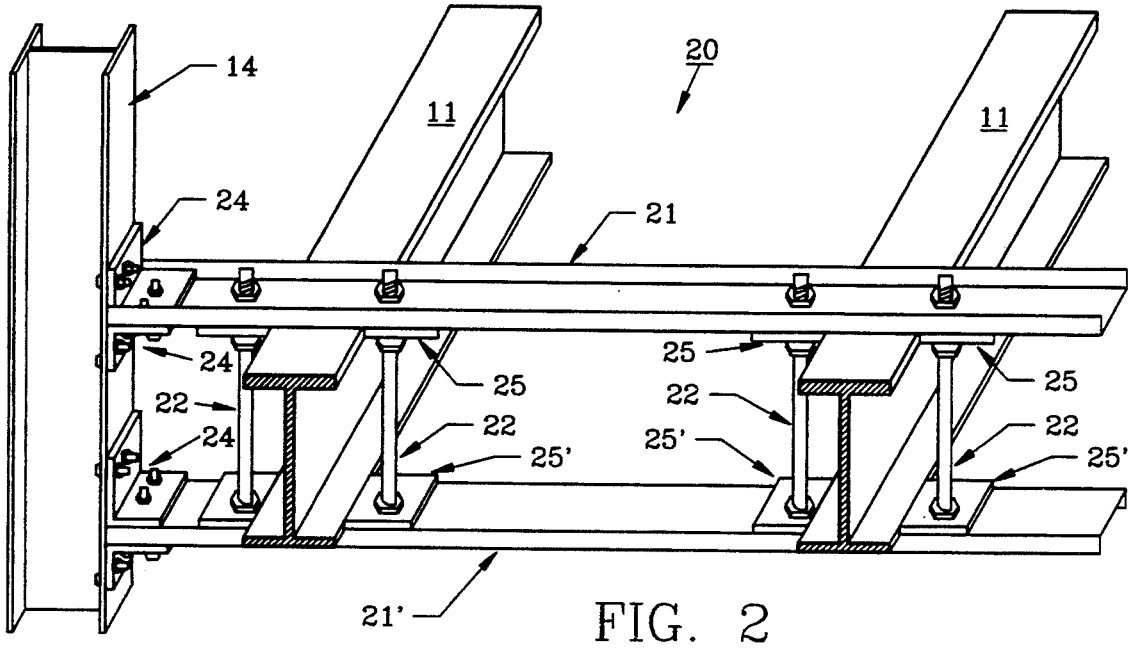
FIG. 2 illustrates an enlarged view of one embodiment of the top and bottom lateral steel members attached to the longitudinal girders with tie rods and lock plates and with bolting to the guardrail post.
Figure 3:
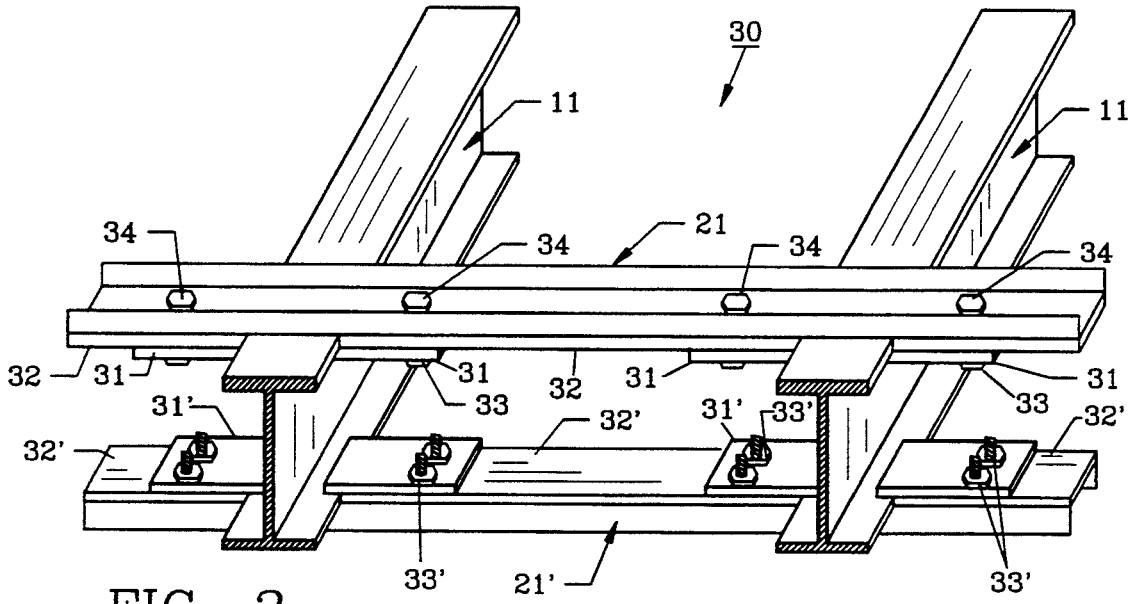
FIG. 3 pictures a perspective view of a section of another embodiment of the invention with spacing plates positioned between the girders and fastened by bolting.
Figure 4:
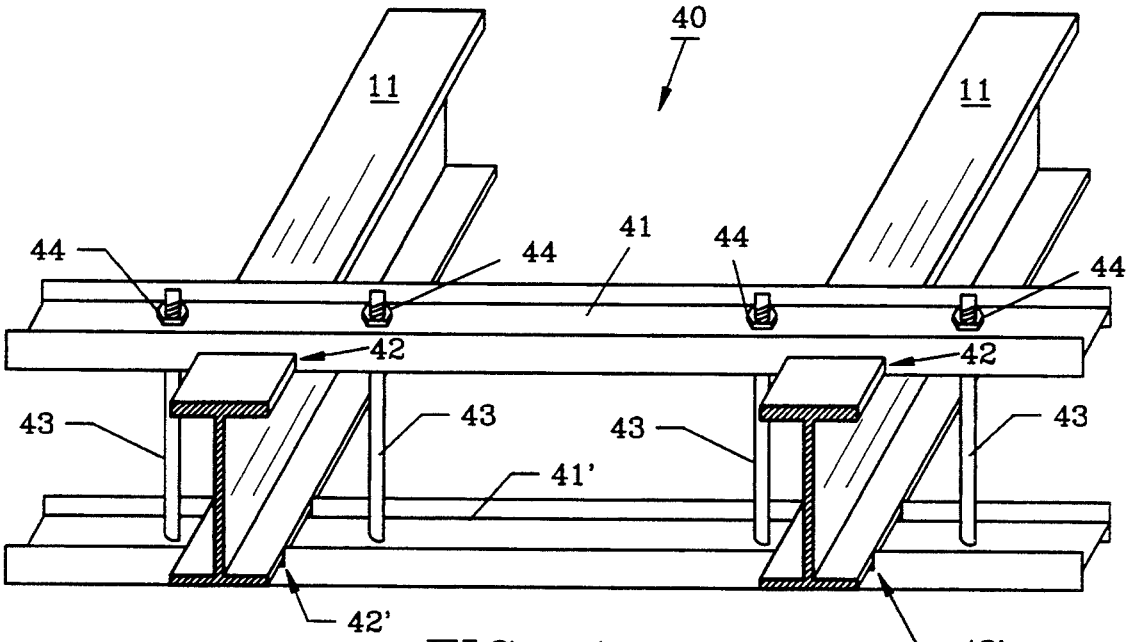
FIG. 4 features a view of another embodiment of a bridge structure section utilizing tie rods with notched steel members.

The preferred structure of the invention is shown schematically in FIGS. 1, 1A and 1B with three basic connections for attachment of the lateral bracing to the longitudinal girders noted in FIGS. 2, 3 and 4. The flanged girders may be for example, up to forty-two inches in height (depth) with ten inch flange widths whereas the lateral brace steel members may be either six inch u-shaped channel or eight inch flanged beam sections as hereinafter described. The intermediate lateral bracing crosses substantially at right angles to the girders but not in excess of twelve degrees from right angle. The two end (approach) cross braces will cross the girders at the bridge skew angle. Vertical guardrail posts are bolted to the lateral braces at each end thereof for the attachment of the bridge side guardrails.

Figure 2B:
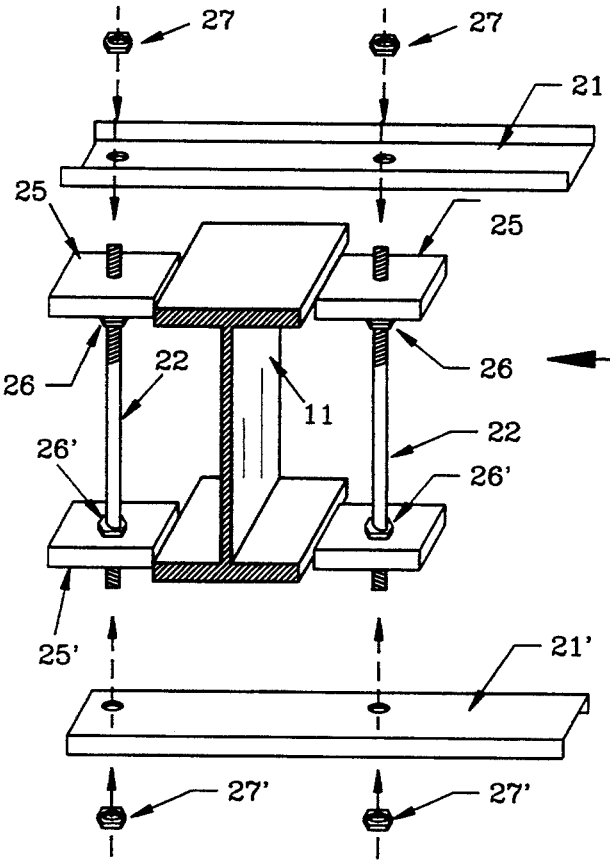
FIG. 2B depicts an enlarged view of the tie rod assembly used in FIGS. 2 and 2A.
Figure 2A:
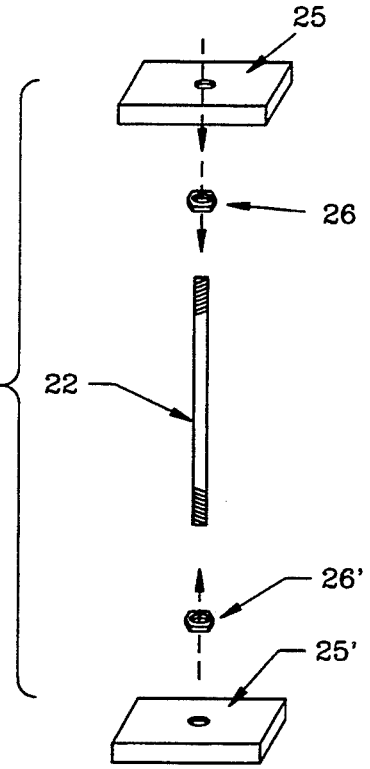
FIG. 2A presents an exploded view of a section of the configuration shown in FIG. 2.

The embodiment demonstrated particularly in FIGS. 2, 2A and 2B is primarily for concrete decking whereby the longitudinal girders are spaced in excess of forty-eight inches apart. As seen in FIG. 2 the lateral brace u-shaped channel bracing members are connected to the longitudinal flanged beam girders by the use of tie rods which pass through apertures in girder locking plates positioned between the girders with locking plates positioned thereagainst with interior locking nuts. The tie rods lock and hold the lateral brace steel members to the longitudinal girders above and below.

Figure 3A:
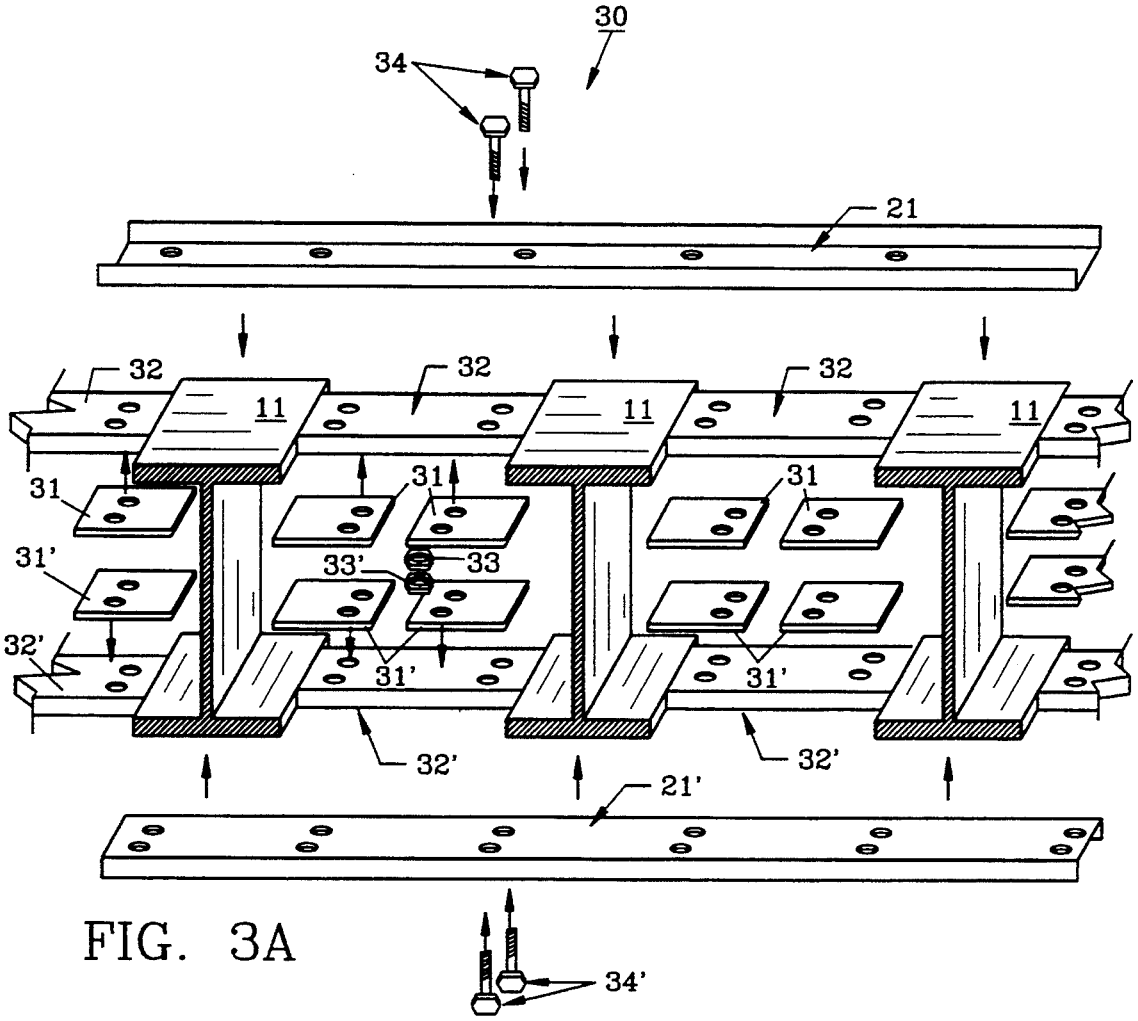
FIG. 3A shows an exploded view of a structure as shown in FIG. 3.

In FIGS. 3 and 3A the embodiment shown is primarily for timber decking whereby the longitudinal girders are close together on twenty-four inch centers. As seen in FIG. 3A the lateral brace u-shaped channel bracing members are connected to the longitudinal flanged beam girders by the use of bolts which pass through apertures in girder spacing plates positioned between the girders and locking plates and are tightened thereagainst with nuts. The locking plates contact the girders and hold the lateral brace members thereabove and therebelow. Five inch thick timber decking (not shown) will be placed across the girders parallel to the lateral bracing and fastened with conventional timber deck bridge bolting.

Figure 4A:
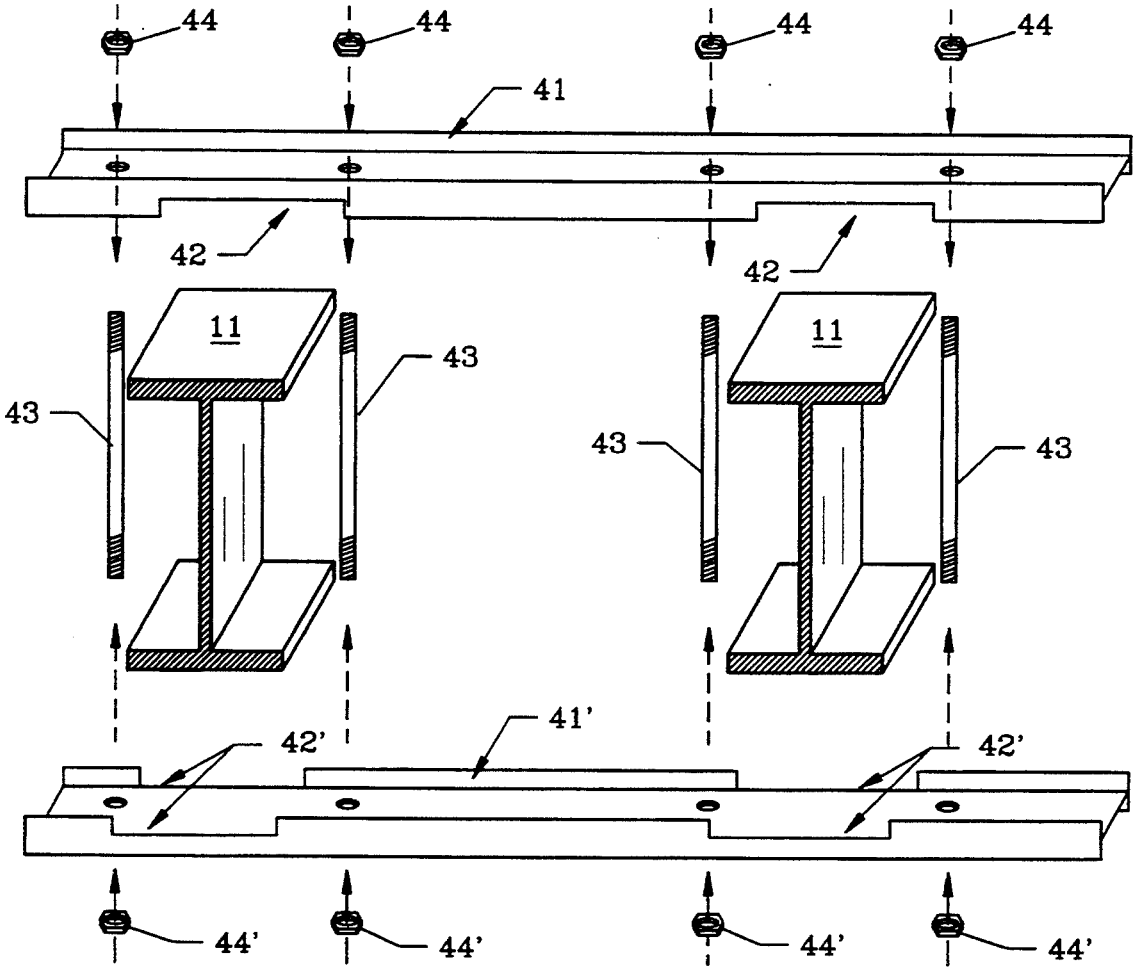
FIG. 4A illustrates an exploded sectional view of the structure as seen in FIG. 4.

In FIGS. 4 and 4A the embodiment shown is primarily for concrete decking whereby the girders are generally spaced in excess of seventy-two inch centers. As seen in FIG. 4A the lateral brace members are flanged beams which have notches therein of a width to receive the top and bottom respectively of the girder and are connected to the longitudinal girder by the use of tie rods which pass through apertures in each brace member which lock and hold the lateral brace members to the longitudinal girder above and below.

DETAILED DESCRIPTION OF THE DRAWINGS AND OPERATION OF THE INVENTION

For a better understanding of the invention, turning now to the drawings, FIG. 1 demonstrates an overall schematic view of a section of bridge structure 10 as shown herein. Structure 10 includes a plurality of girders 11 which consist of flanged steel beams which are maintained in position by lateral braces 16 which have top and bottom members 12, 12' respectively which are in contact with top 17 and bottom flange 17' respectively of girders 11. Lower steel brace members 12' are opposingly vertically aligned with top steel lateral braces 12. Vertical guardrail posts 14 are attached to lateral brace members 12, 12' at the ends thereof. FIG. 1A demonstrates an overall schematic view of bridge structure 10A wherein the plurality of longitudinal girders 11 are uniformly staggered longitudinally to create a skew angle and the resultant intermediate arrangement of lateral steel brace members 12, 12' and end lateral steel brace members 13, 13'. On the opposite corners of bridge structure 10A intermediate lateral brace members 12, 12' and the end lateral brace members 13, 13' intersect i n a "v" configuration 15 with vertical guardrail support post 14 attached thereto. Lateral brace 19 comprises top brace member 13 and bottom brace member 13'. Guardrail support posts 14 on each side are symmetrical with matching longitudinal spacing from girders 11. FIG. 1B demonstrates single lateral brace members 12, 12', 13 and 13' of bridge structure 10 as seen in FIG. 1 exploded and with side rail post 14 removed. As seen, lateral brace members 12, 12', 13, 13' are formed from relatively small steel channels, but other flanged or t-shaped steel components as stated above could be utilized. Longitudinal girders 11 consist of flanged steel beams which are in parallel alignment between lateral brace member 12, 12'.

In FIG. 2 bridge structure 20 is shown in which upper lateral brace member 21, and lower member 21' of a lateral brace comprise u-shaped steel channels which are affixed to longitudinal girders 11 by tie rods 22. Brace members 21, 21' are bolted to side guardrail post 14 by L-shaped (angle) brackets 24. In FIG. 2A an exploded view of a portion of bridge structure 20 is shown in which tie rods 22 are seen separated from brace members 21, 21'. Tie rod plates 25, 25' are adjustably positioned on tie rods 22 via inside locking nuts 26, 26' which are threadably moveable along each end of tie rod 22. Tie rod plates 25, 25' are positioned against locking nuts 26, 26' at each end thereof and are securely held between brace members 27, 21' by tightening outside locking nuts 27, 27'. For clarity, FIG. 2B demonstrates tie rod 22 enlarged and independent of brace members 21, 21'. As would be understood, one edge of rectangular-tie rod plates 25, 25' abuts girder 11 on each side when in place, thus preventing girder movement therebetween.

Another embodiment is seen in FIG. 3 whereby structural section 30 comprises lateral brace members 21, 21' which sandwich girders 11 by the use of girder locking plates 31, 31' (FIG. 3A) and with the use of girder spacers 32, 32'. Locking nuts 33, 33' as shown in FIGS. 3 and 3A maintain bolts 34, 34' respectively, which pass through brace members 21, 21', girder spacers 32, 32' and locking plates 31, 31' to form a laterally stable, rigid bridge structure connection.

Bridge structural section 40 is presented in FIG. 4 with girder 11 between lateral brace members 41, 41' which are formed from small steel flanged beams which have notches 42, 42' therein to receive the top and bottom respectively of girder 11. In structural section 40 tie rod plates are not utilized as notches 42, 42' maintain girder 11 securely in position when tie rods 43 are tightened with locking nuts 44, 44' as shown in FIG. 4A. Lateral brace members 41, 41' consists of horizontally positioned I-beams which may be for example one-fifth to one-half the overall size of girders 11.

Modifications to the examples shown herein may be made without departing from the intent and scope of the present invention and the examples herein are merely for explanatory purposes and are not intended to limit the scope of the appended claims.

I claim:

1. A bridge structure comprising: a plurality of longitudinal girders which are affixed in place by a plurality of lateral braces jointed thereto, each lateral brace comprising a pair of lateral members, one of said lateral members positioned continuously across the top of said plurality of longitudinal girders and the second of said lateral members positioned across the underside of said longitudinal girders, said first of said pair of lateral members vertically aligned with said second of said lateral members, a plurality of parallel tie rods, said tie rods adjacent to said longitudinal girders, at least one of said tie rods positioned on each of opposite sides of each of said girders, said tie rods affixed to said lateral members.

2. The bridge structure of claim 1 wherein said first of said pair of lateral members is affixed to the top of each of said girders and said second of said pair of lateral members is affixed to the bottom of each of said girders.

3. The bridge structure of claim 1 wherein said tie rods are spaced from said girders.

4. The bridge structure of claim 1 wherein each of said parallel tie rods extends beside said longitudinal girders, each of said parallel tie rods attached at one end to said first lateral member and at the other end to said second lateral member, said first lateral member urged downwardly by said tie rod and said second lateral member urged upwardly by said tie rod.

5. The bridge structure of claim 1 and including a side guardrail post, said post attached to said lateral brace.

6. The bridge structure of claim 1 and including girder spacers, the surfaces of said girder spacers defining apertures, said apertures for receiving said tie rods, said spacers positioned between said girders and attached to one of said lateral members by said tie rods.

7. The bridge structure of claim 6 and including locking plates, said locking plates having surfaces defining apertures, said apertures for receiving said tie rods, said locking plates affixed to said girder spacers by said tie rods.

8. The bridge structure of claim 1 wherein said girders have continuous, uninterrupted outer surfaces.

9. The bridge structure of claim 1 and including a girder locking plate, said girder locking plate positioned on one end of one of said tie rods for contacting said lateral member.

10. The bridge structure of claim 1 and including an outside locking nut, said nut threadably affixed to one end of one of said tie rods to urge said lateral member against said girders.

11. The bridge structure of claim 9 and including an inside locking nut, said inside locking nut positioned on one end of one of said tie rods inside of said girder locking plate.

12. The bridge structure of claim 2 wherein said girders are frictionally held in place between said first and second lateral members.

13. A bridge structure comprising:

(a) a plurality of longitudinal girders, said girders having continuous, uninterrupted outer surfaces;

(b) a plurality of lateral braces, said lateral braces each comprising a first lateral member vertically aligned with a second lateral member, said first lateral members positioned atop each of said girders and said second lateral members positioned beneath each of said girders;

(c) a plurality of elongated, threaded, parallel tie rods, said tie rods adjacent said longitudinal girders, at least one of said tie rods positioned on each of opposite sides of each of said girders;

(d) a plurality of locking nuts, said locking nuts sized to engage said threaded tie rods; wherein said tie rods are attached to said first lateral members by said locking nuts, said tie rods urging said first lateral members downwardly into frictional contact with said longitudinal girders, said tie rods attached to said second lateral members by said locking nuts, said tie rods urging said second lateral members upwardly into frictional contact with said longitudinal girders, said longitudinal girders frictionally held in place between said first and second lateral members.

14. The bridge structure of claim 13 wherein each of said elongated, threaded, parallel tie rods is attached at one end to one of said first lateral members by certain of said locking nuts and at the other end to opposing said second lateral member by other of said locking nuts, said first and second lateral members urged towards each other by said tie rods.

* * * * *